United States Patent [19]

Nickel et al.

[11] Patent Number: 4,525,377

[45] Date of Patent: Jun. 25, 1985

[54] METHOD OF APPLYING COATING

[75] Inventors: Gerhard E. B. Nickel, Kennesaw; Alfred C. Alberghini, Dunwoody, both of Ga.

[73] Assignee: Sewell Plastics, Inc., Atlanta, Ga.

[21] Appl. No.: 458,347

[22] Filed: Jan. 17, 1983

[51] Int. Cl.[3] ..... B05D 1/18

[52] U.S. Cl. ..... 427/12; 427/322; 427/377; 427/378; 427/393.5; 427/430.1

[58] Field of Search ..... 427/12, 322, 377, 378, 427/393.5, 430.1

[56] References Cited

U.S. PATENT DOCUMENTS

| | | | |
|---|---|---|---|
| 3,600,208 | 8/1971 | Abbott | 117/7 |
| 4,092,543 | 5/1978 | Levy | 250/423 R |
| 4,127,633 | 11/1978 | Addeman | 264/7 |
| 4,216,518 | 8/1980 | Simons | 361/213 |
| 4,254,170 | 3/1981 | Roullet | 428/36 |
| 4,423,462 | 12/1983 | Antonevich | 361/235 |

FOREIGN PATENT DOCUMENTS 1107957 3/1968 United Kingdom .

OTHER PUBLICATIONS

Modern Plastics, Delassus et al., 1-83, pp. 86-88.

*Primary Examiner*—Bernard D. Pianalto
*Attorney, Agent, or Firm*—Barnes & Thornburg

[57] ABSTRACT

A method for applying a PVDC polymer coating to the outside of a PET parison includes deionizing the surface of the parison, dipping the parison into an aqueous PVDC dispersion, withdrawing the parison at a controlled rate to prevent slubbing of the polymer coating, and drying the coating by exposure to desiccated air. The method dramatically reduces the energy requirements for coating operations yet produces a finished biaxially oriented PET container having superior gas barrier characteristics.

8 Claims, 4 Drawing Figures

METHOD OF APPLYING COATING

This invention relates to a process for the production of a coated gas-tight and flavor-tight biaxially oriented polyethylene terephthalate container from a parison of amorphous polyethylene terephthalate. More particularly, it relates to a process that permits the coated container to be made in an energy-efficient manner that reduces the danger of coating damage and thus increases the efficacy of the final container.

Polyethylene terephthalate is hereinafter referred to as PET, by which term we include not only the homopolymer formed by the polycondensation of $\beta$-hydroxyethyl terephthalate but also copolyesters containing minor amounts of units derived from other glycols or diacids, e.g. isophthalate copolymers.

The manufacture of biaxially oriented PET containers is well known in the art. Biaxially oriented PET containers are strong and have good resistance to creep. Containers of relatively thin wall and light weight can be produced that are capable of withstanding, without undue distortion over the desired shelf life, the pressures exerted by carbonated liquids, particularly beverages such as soft drinks, including colas, and beer.

Thin-walled PET containers are permeable to some extent to gases such as carbon dioxide and oxygen and hence permit loss of pressurizing carbon dioxide and ingress of oxygen which may affect the flavor of the bottle contents. This is particularly important with some beverages and where the container is relatively small and the ratio of surface area of the container to contents volume is larger than with larger containers. It is therefore desirable to provide the container with a layer of a barrier material which has a low vapor and gas permeability. Barrier layers may be provided by a variety of techniques, including coextrusion, etc., so as to form a laminar preform or parison which upon blow-molding becomes a coated container.

One method of applying a barrier layer to a parison is to contact an inside or outside surface of the parison with an aqueous suspension or dispersion of a vinylidene chloride copolymer. The object is then to remove the water from the suspension leaving a uniformly distributed layer of the polymer in place which will form a continuous barrier after the blow molding of the parison to container form. In the prior art, this method has customarily used an aqueous dispersion of a copolymer of vinylidene chloride with acrylonitrile and/or methyl acrylate optionally containing units derived from other monomers such as methyl methacrylate, vinyl chloride, acrylic acid, or itaconic acid. Useful vinylidene chloride copolymers are those containing 5 to 10% by weight of units derived from acrylonitrile and/or methyl acrylate, and optionally containing up to 10% by weight of units derived from an unsaturated carboxylic acid such as acrylic acid. The dispersions contain surfactants such as sodium alkyl sulphonates. For simplicity, dispersions of this general kind will be hereinafter referred to as PVDC dispersions.

Many variations in the basic method have been tried in an attempt to form the desired uniform continuous barrier layer, examples of which are to be found in U.S. Pat. Nos. 3,804,663; 4,127,633; and 4,254,170 as well as British Pat. No. 1,107,957. All the methods, however, in the above examples require enormous energy consumption in either the coating operation or in the drying operation. Additionally, the danger of pinholing occurring in the film coating during drying in the above examples is prohibitively high.

The method of coating utilized in the present invention is a controlled dip and withdrawal of the PET parison into and out of a vat containing the PVDC coating material at a rate below which slubbing of the film coat is observed. Because of the controlled dip cycle, the PVDC dispersion can be maintained at room temperature, resulting in a considerable saving in energy over other dipping techniques that require maintenance of the coating material at elevated temperatures.

Additionally, the film-coated container is preferably dried under desiccated air rather than elevated temperatures or radiant heat as used in other dipping methods. Desiccated air is used to refer to air having a partial pressure for water vapor of substantially zero. Not only is there an energy savings realized using desiccated air rather than elevated temperatures or radiant heat, but the danger of pinholing in the film coat is reduced, thus increasing the efficacy of the film coat. This can be explained by the fact that when a desiccation technique is used, water molecules are drawn out of the film coating at low velocity by the low partial pressure of the desiccated air. When a heating technique is utilized, as in the prior art, the water molecules are energized to an excited state and exit the coat with a far greater velocity which exit breaks the continuity of the outer surface of the drying film.

In accordance with the method of the present invention, the steps involved in forming the coated gas-tight and flavor-tight biaxially oriented PET container includes (a) deionizing the surface of the PET parison which is to be coated; (b) dipping the parison into a vat containing the coating material; (c) withdrawing the parison and an adherent film of the coating material from the vat at a rate below that at which film slubbing is observed; (d) drying the film-coated parison; and (e) stretching the film-coated parison biaxially at a temperature suitable for orientation of the PET into a container.

The coating material comprises a crystalline PVDC dispersion or latex. The latex, when applied to a PET container, greatly reduces the permeation rate of a variety of gases through the container walls in a predictable and well known manner. The experimental Saran XD-30564.01, manufactured by Dow Chemical Corporation, at this time has provided the most satisfactory results when the method of the present invention is utilized. This particular PVDC dispersion is said to have the following typical characteristics: 58 percent solids, a specific gravity of 1.30, a pH of 2, a viscosity of 24 centipoise (Brookfield, 60 rpm, LVI, 22° C.), and a particle size of between 1,400 and 1,800 angstroms.

Also in accordance with the present invention, an apparatus for producing a coated gas-tight and flavor-tight biaxially oriented PET container comprises a number of operation stations including a deionizer, a dipping vat containing the PVDC latex, and a carousel dryer in spaced relationship to a robotic central turntable conveyor. The robotic central turntable conveyor is used for advancing PET parisons from one operation station to another such that a continuous manufacturing process for the formation of the coated gas-tight and flavor-tight parisons for biaxially oriented PET containers can be achieved. The process is most advantageously carried out in combination with one or more molding machines which are concurrently producing the parisons. In this way, the dipping step can occur while the parison is still warm from its formation, thereby enhancing the film formation without any additional expenditure of energy.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which.

DETAILED DESCRIPTION OF THE DRAWING

Figure 1:
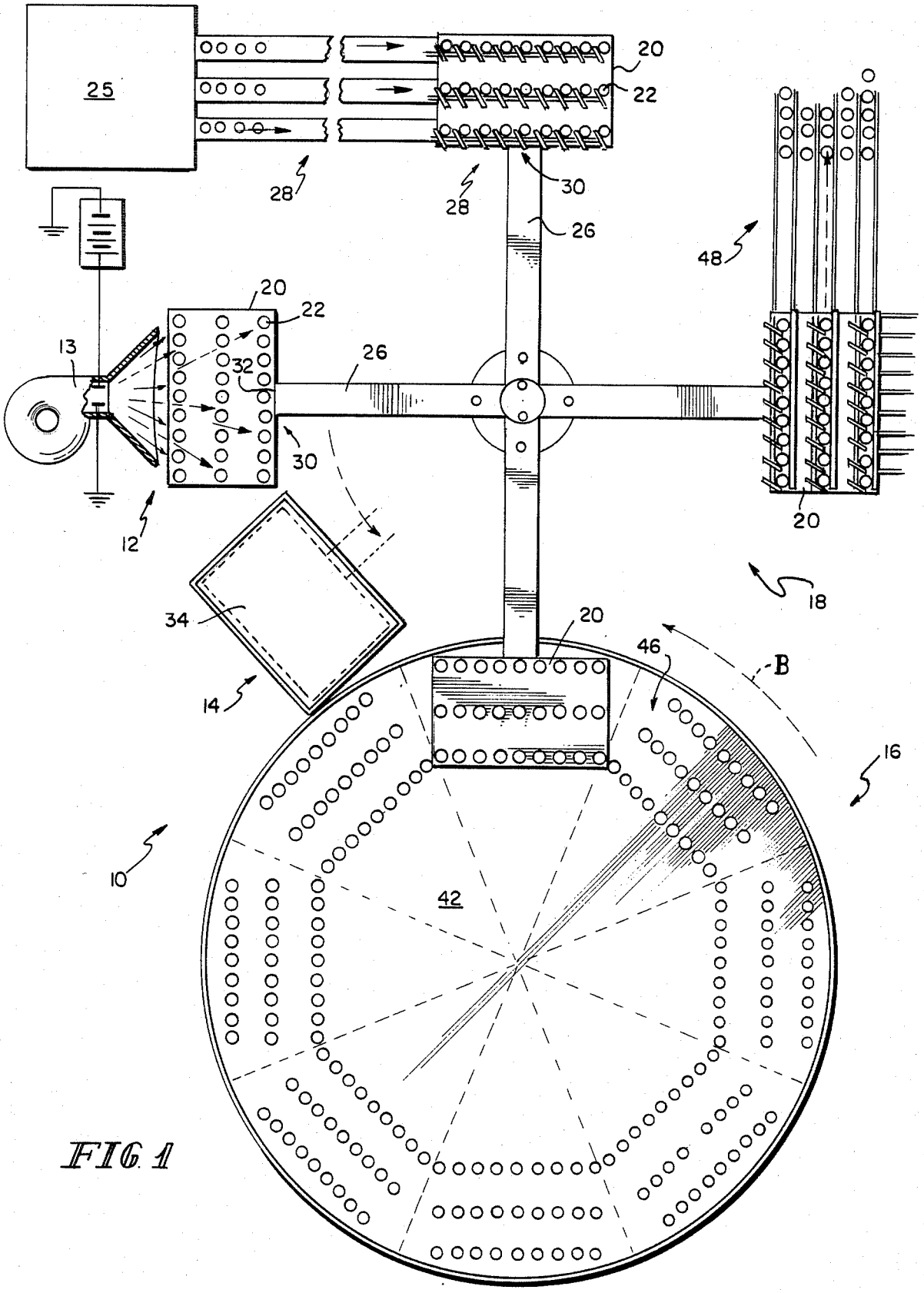
FIG. 1 is a schematic plan view of an apparatus used to carry out the method of producing a coated gas-tight and flavor-tight parison for a biaxially oriented PET container according to the present invention.
Figure 2:
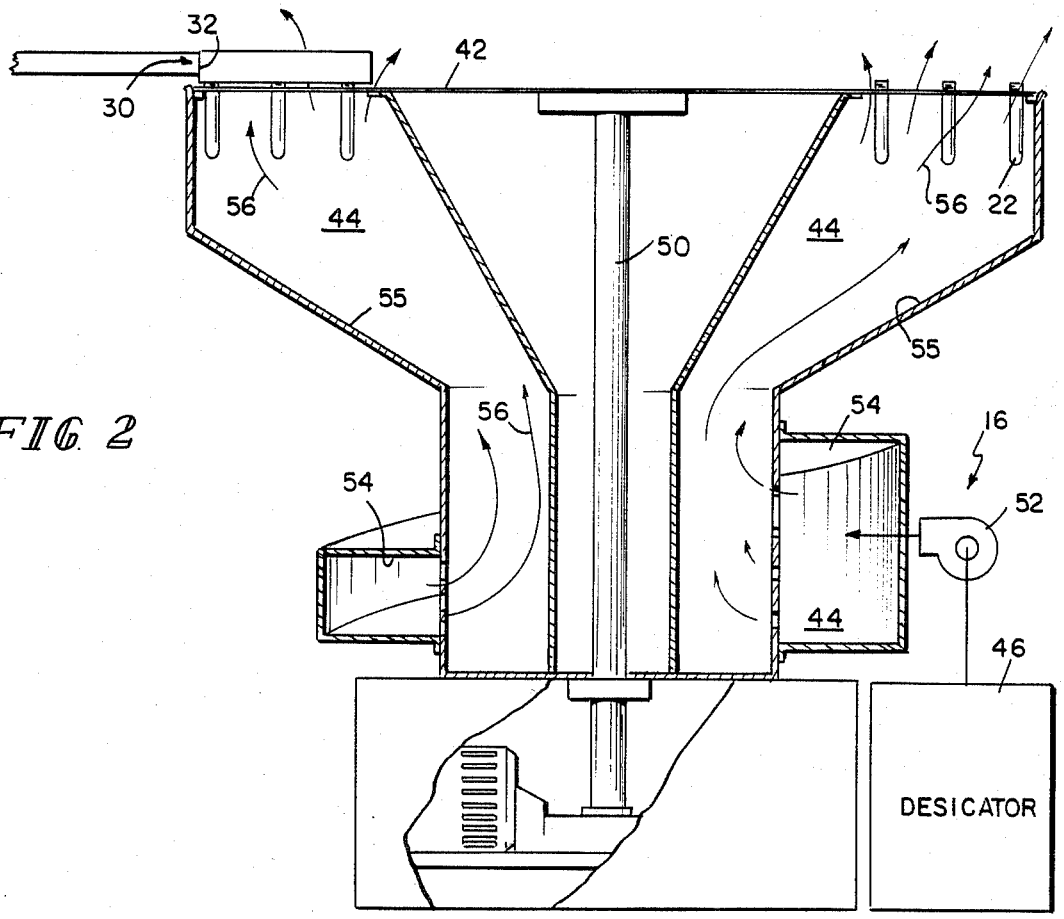
FIG. 2 is a transverse view of the carousel dryer as shown in FIG. 1 partially broken away.

An apparatus 10 for the production of a coated gas-tight and flavor-tight biaxially oriented PET container parison is shown in FIGS. 1 and 2. Apparatus 10 has a number of operation stations including a deionizer 12, a coating vat 14, and a carousel dryer 16 in spaced relationship to a robotic central transfer means 18. A rack 20 for handling a plurality of parisons 22 is loaded by an infeed conveyor 24 from a parison molding machine 25 or other source. An arm 26 of the robotic central transfer means 18 carries the rack 20 which is provided with a coupling mechanism 30 on its side 28. The coupling mechanism 30 of rack 20 is cooperatively attachable to the distal end 32 of arm 24. As rack 20 makes contact with the distal end 32 of arm 26, the coupling mechanism 30 engages and the rack 20 is lifted from infeed conveyor 24. The rack 20 is then advanced by transfer means 18 to the first operation station, deionizer 12, where the parisons are deionized to ensure a dust-free and charge-free surface on the parison 22 prior to the coating application. Any conventional commercial iomizer 13 can be used, such as an Aerostat Model AS-20A ionizing blower available from the Simco Company, Inc. of Lansdale, Pa.

Rack 20 is then advanced by the transfer means 18 to the second operation station, the coating vat 14. The coating vat 14 contains a latex dispersion of a high-barrier PVDC 34. Upon advancement by the transfer means 18 to the coating vat 14, the rack 20 containing the parisons 22 is lowered into the vat 14. The latex 34 is maintained at room temperature and is applied to the parisons 22 at room temperature. Where the dipping occurs within a short time after parison formation, the parisons 22 may be somewhat warmer than room temperature but a separate heating step is avoided. This results in a considerable energy saving when compared to known barrier layer dipping techniques that require heating of the latex 34 or heating of the parison 22 prior to the dip.

Figure 3:
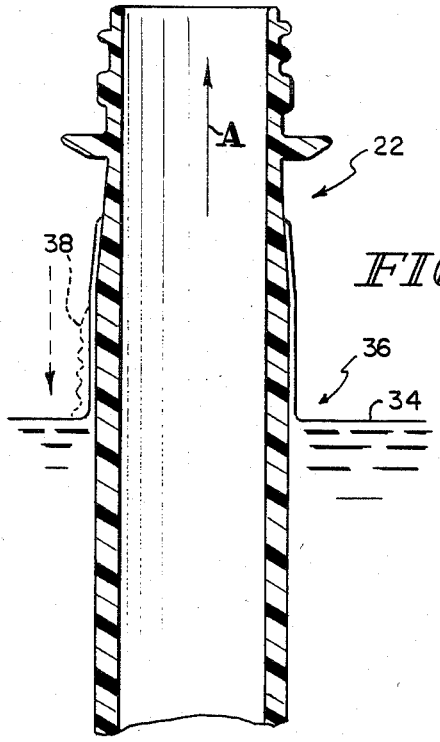
FIG. 3 is a partially cut-away cross-sectional view of the film formation on a dipped parison partially removed from the dipping vat.

It has been found that the rate of removal of the parisons 22 out of latex 34 contained in vat 14 is extremely critical in obtaining a uniform film coat 36 upon the parison 22. For simplicity of design, the dip velocity and removal velocity can be the same. The parison 22 in FIG. 3 is shown partially removed and moving in the direction of arrow A from the latex 34. If the parison is removed at or below the recommended velocity, a uniform film 36 of PVDC latex 34 adheres to the side of parison 22. If the parison 22 is removed too quickly, the film 36 slubbs as shown in FIG. 3 on side 38 of the parison 22. The slubbing which results from too quick a removal of the parison is believed to streak or tear the film 36 such that it does not provide an adequate barrier to oxygen, carbon dioxide, or other intended gases. To obtain the uniform film, the removal velocity should be less than about 2 centimeters per second.

The rate of dip and rate of removal can be controlled by any conventional method, such as a suitably configured cam, cam-follower device attached to a drive means, or, as an alternative, an appropriately selected gear configuration such as a rack and pinion attached to a suitable drive means.

Figure 4:
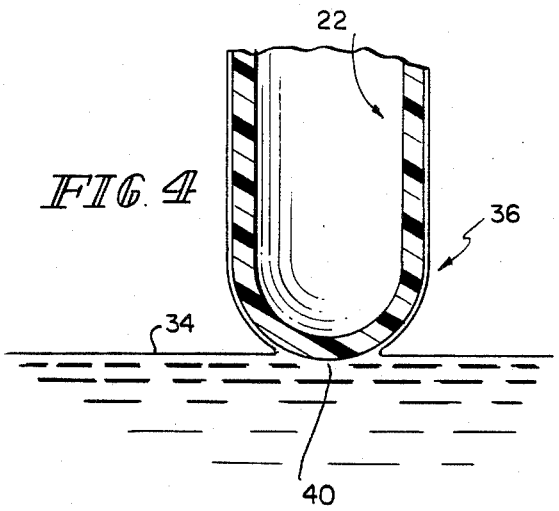
FIG. 4 is a partially cut-away cross-sectional view of the film formation on a dipped parison completely removed from the dipping vat.

It should be noted that as an alternative to dipping the parisons 22 into the latex 34 contained in vat 14, the vat 14 could be raised and lowered to submerge and demerge the parison 22 in the latex 34 to achieve the desired film coat 36. In either process, the critical rate of removal of the parison 22 from the latex vat 34 is thought to be about the same. FIG. 4 shows the formation of a uniform film of latex 36 over the entire surface of parison 22 which, when the parison 22 is blow-molded into a container, provides a uniform and efficient barrier to gasses in and out of the finished container. If the parisons 22 are removed from the latex vat 34 at the preferred rate, substantially no post emergence dripping of liquid occurs from the ends 40 of the removed parisons.

Upon completion of the dipping operation, the rack 20 containing parison 22 is advanced on transfer means 18 to the carousel dryer 16. Upon proper alignment with the carousel dryer 16, the rack 20 is off-loaded into a suitably configured rack holder 42. The dryer 16 is provided with a drive shaft 50 that is geared to advance the racks 20 along with rack holder 42 around the dryer 16 in direction B. During the advancement of the parisons 22 around the dryer 16, they are continually exposed to desiccated air 44. The desiccated air 44, normally dried over a silicate in desicator 46, is forced upwardly by blowers 52 into plenum 54 and registers 55 to achieve a substantially streamlined flow 56 of desiccated air 44 over the film-coated parisons 22. The air 44 need not be heated or used in conjunction with any radiant heat supply in order to provide the drying capacity necessary to adequately dry the film-coated parisons 22. This results in a considerable energy savings when compared to the other conventional drying techniques used to dry film-coated parisons. While heated air can be used to dry the parisons, by using desiccated air rather than elevated temperatures or radiant heat, the danger of pinholing in the dry film coat is greatly reduced. It has been found that for a PVDC latex film of about 0.2–0.4 millimeters thickness, satisfactory drying of the entire surface of the parisons 22 can be achieved in about 2.8 minutes when exposed to a low turbulence or streamline flow of room temperature (approximately 20° C.) desiccated air of between 400–800 CFM.

Upon reaching the off-load position 46, the rack 20 containing the dried film-coated parisons 22 is once again coupled to the arm 26 by coupling mechanisms 30 and moved by transformers 18 to a discharge conveyor 48. Alternatively, a separate mechanism (not shown) can be provided to off-load the rack 20 from the carousel dryer 16. The dry film-coated parisons 22 can then be made into a biaxially stretched hollow body container in the usual manner and under the usual pressures and temperature conditions.

It can be seen that all of the above-described operations of deionization, dipping, drying, and blow-molding can take place simultaneously in a continuous operation when the method of the present invention is used. Although the invention has been described in detail with reference to certain preferred embodiments, variations and modifications exist wthin the scope and spirit of the invention as described and as defined in the following claims.

What is claimed is:

1. A method for producing a parison of amorphous PET having an outside coating comprising the steps of:

(a) deionizing the surface of an amorphous PET parison;

(b) dipping the parison into an aqueous PVDC dispersion;

(c) withdrawing the parison and an adherent film of the PVDC dispersion below the rate at which film slubbing is observed; and (d) exposing the parison and film to ambient temperature desiccated air until the film is substantially dried.

2. The method of claim 1 wherein step (d) comprises passing a substantially streamline flow of desiccated air over the surface of the parison.

3. The method of claim 2 wherein the parison is exposed to the dessicted air in step (d) for about 2.8 minutes.

4. The method of claim 1 wherein the aqueous PVDC dispersion is maintained at room temperature.

5. The method of claim 1 wherein the PET parison is withdrawn from the aqueous PVDC dispersion at a velocity of less than about 2 cm/sec.

6. In the process of applying a PVDC coating to an amorphous PET parison by dipping said parison into an aqueous PVDC dispersion and drying said coated parison, the improvement which comprises deionizing the surface of the parison prior to dipping it in the PVDC dispersion, withdrawing the parison and an adherent film of the PVDC dispersion from the PVDC dispersion at a rate below that of which film slubbing is observed, and exposing the PVDC film-coated parison to ambient temperature desiccated air until the film is substantially dried.

7. The improvement of claim 6 wherein the aqueous PVDC dispersion is maintained at about room temperature.

8. The improvement of claim 6 wherein the PET parison is withdrawn from the aqueous PVDC dispersion at a velocity of less than about 2 cm/sec.

* * * * *

UNITED STATES PATENT AND TRADEMARK OFFICE

CERTIFICATE OF CORRECTION

PATENT NO. : 4,525,377

DATED : June 25, 1985

INVENTOR(S) : Gerhard E. B. Nickel and Alfred C. Alberghini

It is certified that error appears in the above-identified patent and that said Letters Patent is hereby corrected as shown below:

IN THE CLAIMS

In claim 3, line 2, replace "dessicted" with --dessicated--.

Signed and Sealed this

*Thirty-first* Day of *December 1985*

[SEAL]

*Attest:*

DONALD J. QUIGG

*Attesting Officer*

*Commissioner of Patents and Trademarks*